US011666168B2

(12) United States Patent
Christopher

(10) Patent No.: US 11,666,168 B2
(45) Date of Patent: Jun. 6, 2023

(54) FOOD DELIVERY RECEPTACLE ASSEMBLY

(71) Applicant: Weyman Christopher, Lithonia, GA (US)

(72) Inventor: Weyman Christopher, Lithonia, GA (US)

( * ) Notice: Subject to any disclaimer, the term of this patent is extended or adjusted under 35 U.S.C. 154(b) by 0 days.

(21) Appl. No.: 17/482,087

(22) Filed: Sep. 22, 2021

(65) Prior Publication Data

US 2023/0091818 A1 Mar. 23, 2023

(51) Int. Cl.

| | |
|---|---|
| ***A47G 29/14*** | (2006.01) |
| ***A47G 29/30*** | (2006.01) |
| ***G07C 9/00*** | (2020.01) |

(52) U.S. Cl.

CPC ..... *A47G 29/141* (2013.01); *A47G 29/30* (2013.01); *G07C 9/00571* (2013.01); *G07C 9/00896* (2013.01); *A47G 2029/142* (2013.01)

(58) Field of Classification Search

None

See application file for complete search history.

(56) References Cited

U.S. PATENT DOCUMENTS

| | | | | |
|---|---|---|---|---|
| 5,774,053 | A | 6/1998 | Porter | |
| 10,039,401 | B1 * | 8/2018 | Romanucci | A47G 29/141 |
| 10,383,471 | B1 * | 8/2019 | Barnes | A47G 29/124 |
| 10,786,103 | B2 * | 9/2020 | Teoh | B65D 11/1853 |
| 10,842,305 | B1 | 11/2020 | Alcolea | |
| 10,915,856 | B2 * | 2/2021 | Fee | G06Q 10/087 |
| 10,932,602 | B2 | 3/2021 | Hauck | |
| 11,253,096 | B2 * | 2/2022 | Bartley-Clark | A47G 29/30 |
| 2017/0127868 | A1 | 5/2017 | Adewuyi | |
| 2022/0114847 | A1 * | 4/2022 | Emde | G06K 7/1413 |

FOREIGN PATENT DOCUMENTS

| | | |
|---|---|---|
| WO | WO0148641 | 7/2001 |
| WO | WO0151744 | 7/2001 |

* cited by examiner

*Primary Examiner* — K. Wong

(57) ABSTRACT

A food delivery receptacle assembly for protecting food deliveries includes a box in which a set of openings is positioned. A food container can be inserted into the box through a respective opening. Each of a set of panels is hingedly engaged to the box and is positioned to selectively close a respective opening. Insulation is engaged to an inner surface of the box and to an inner face of each panel. The insulation reduces heat transfer between food in the food container and air outside of the box. Each of a set of locks is engaged to the box and is selectively engageable to a respective panel. The locks are electronically actuated to deter unauthorized access to the food container. The locks can be deactivated to permit authorized access to the food container, thus allowing access to the box by a delivery agent and a user.

14 Claims, 5 Drawing Sheets

FOOD DELIVERY RECEPTACLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to delivery receptacles and more particularly pertains to a new delivery receptacle for protecting food deliveries. The present invention discloses an electronically lockable delivery receptacle designed to secure and to insulate food containers that are delivered without contact between a user and a delivery agent.

(2) Description of Related Art Including Information Disclosed Under 37 CFR 1.97 and 1.98

The prior art relates to delivery receptacles. Prior art to delivery receptacles may comprise electronically lockable residential parcel delivery boxes. What is lacking in the prior art is an electronically lockable delivery receptacle designed to secure food containers that are delivered without contact between a user and a delivery agent.

BRIEF SUMMARY OF THE INVENTION

An embodiment of the disclosure meets the needs presented above by generally comprising a box in which a set of openings is positioned. A respective opening is configured for insertion of a food container into the box. Each of a set of panels is hingedly engaged to the box and is positioned to selectively close a respective opening. Insulation is engaged to an inner surface of the box and to an inner face of each panel. The insulation is configured to reduce heat transfer between food in the food container and air outside of the box. Each of a set of locks is engaged to the box and is selectively engageable to a respective panel. The locks are electronically actuated and are configured to be actuated to deter unauthorized access to the food container. The locks are configured to be deactivated to permit authorized access to the food container, thus allowing access to the box by a delivery agent and a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
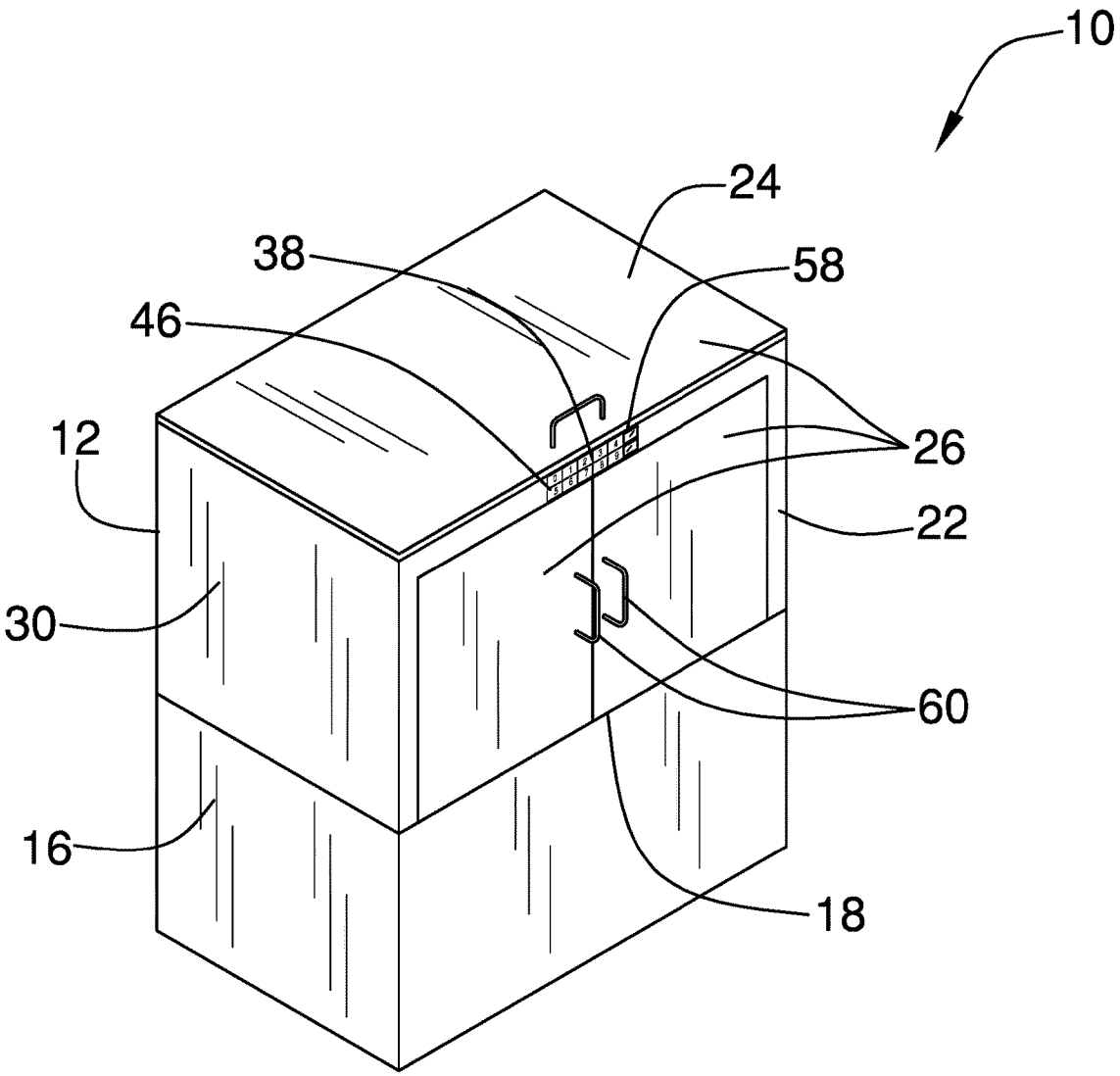
FIG. 1 is an isometric perspective view of a food delivery receptacle assembly according to an embodiment of the disclosure.

With reference now to the drawings, and in particular to FIGS. 1 through 6 thereof, a new delivery receptacle embodying the principles and concepts of an embodiment of the disclosure and generally designated by the reference numeral 10 will be described.

Figure 6:
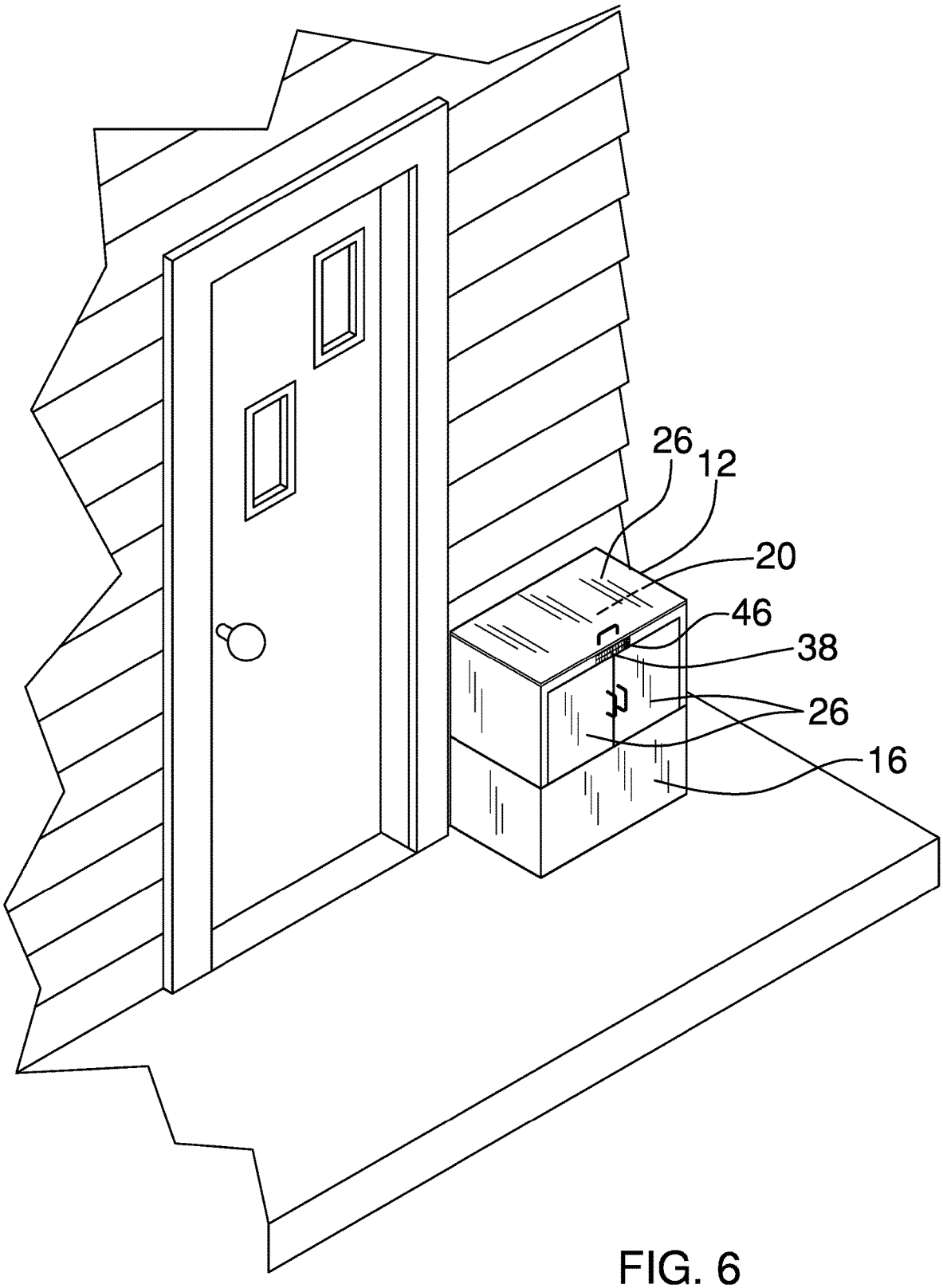
FIG. 6 is an in-use view of an embodiment of the disclosure.

As best illustrated in FIGS. 1 through 6, the food delivery receptacle assembly 10 generally comprises a box 12 in which a set of openings 14 is positioned. As shown in FIG. 6, a base 16 is engaged to and extends from a bottom 18 of the box 12 so that the box 12 is elevated above a surface upon which the base 16 is positioned. The box 12 being elevated positions it at a height that is convenient to a user. The box 12 also may be configured to be mountable to an exterior surface of a residence.

Figure 2:
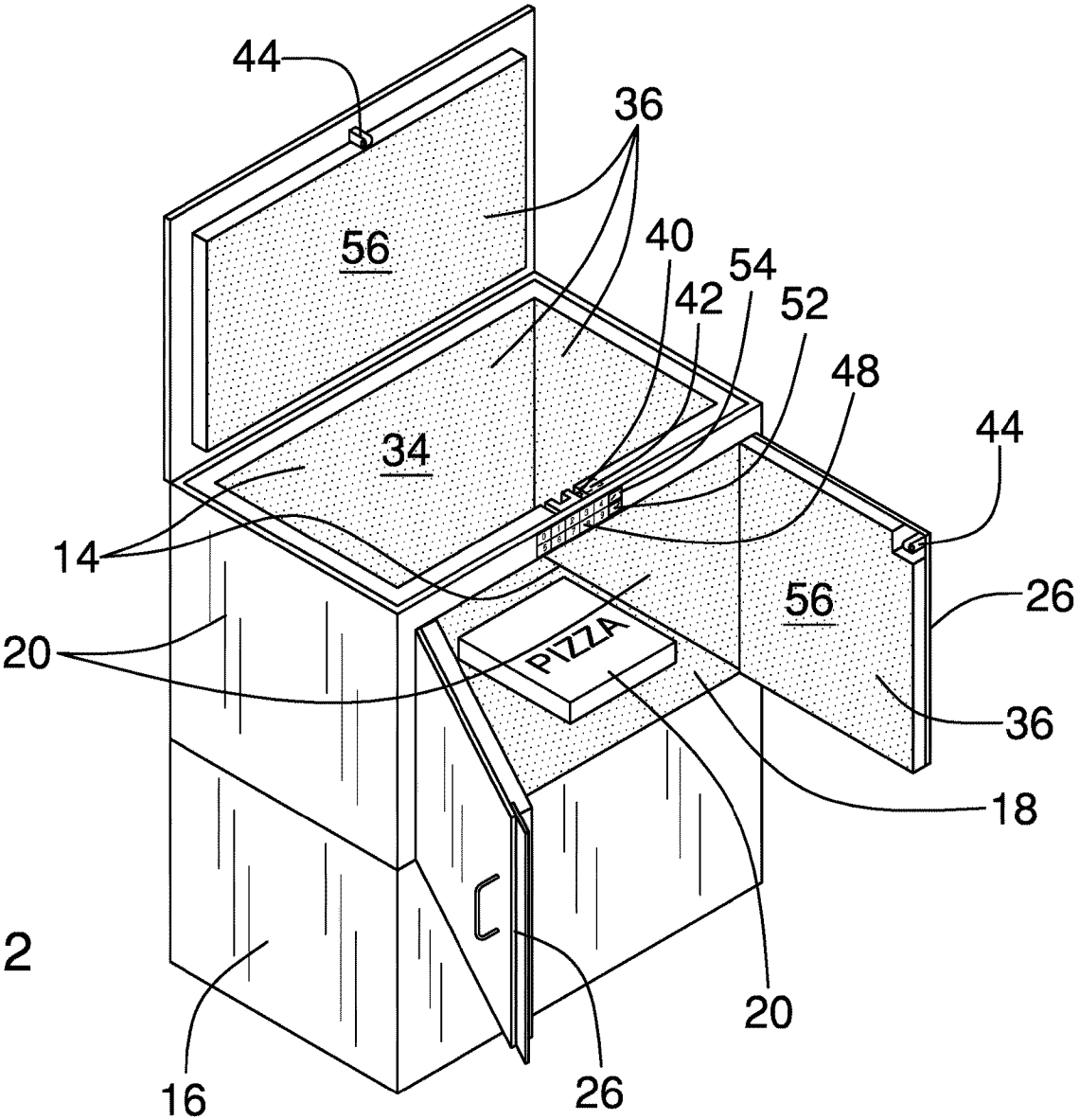
FIG. 2 is an isometric perspective view of an embodiment of the disclosure.

A respective opening 14 is configured for insertion of a food container 20 into the box 12. The set of openings 14 may comprise one opening 14, which is positioned in a front 22 of the box 12. The set of openings 14 also may comprise one opening 14, which is positioned in a top 24 of the box 12. As shown in FIG. 2, the set of openings 14 comprises two openings 14, which are positioned singly in the front 22 and the top 24 of the box 12.

Each of a set of panels 26 is hingedly engaged to the box 12 and is positioned to selectively close a respective opening 14. As shown in FIG. 2, the set of panels 26 comprises three panels 26. One panel 26 is hingedly engaged to the box 12 proximate to a back 28 of the box 12 and thus is positioned to close the opening 14 positioned in the top 24 of the box 12. Each of the other two panels 26 is hingedly engaged to the box 12 proximate to a respective opposed side 30 of the box 12. These panels 26 are positioned to close the opening 14 positioned in the front 22 of the box 12.

Figure 3:
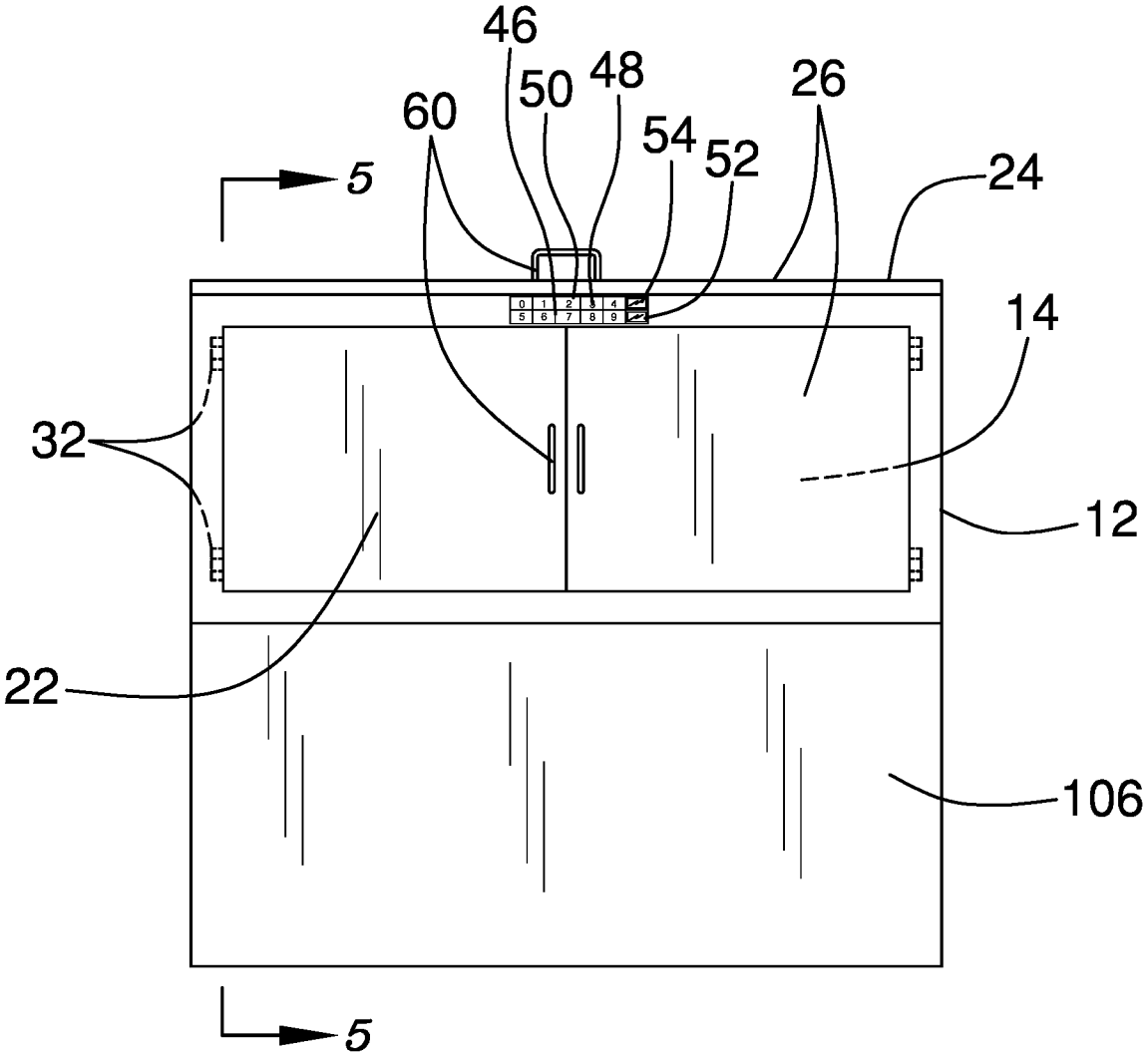
FIG. 3 is a front view of an embodiment of the disclosure.
Figure 5:
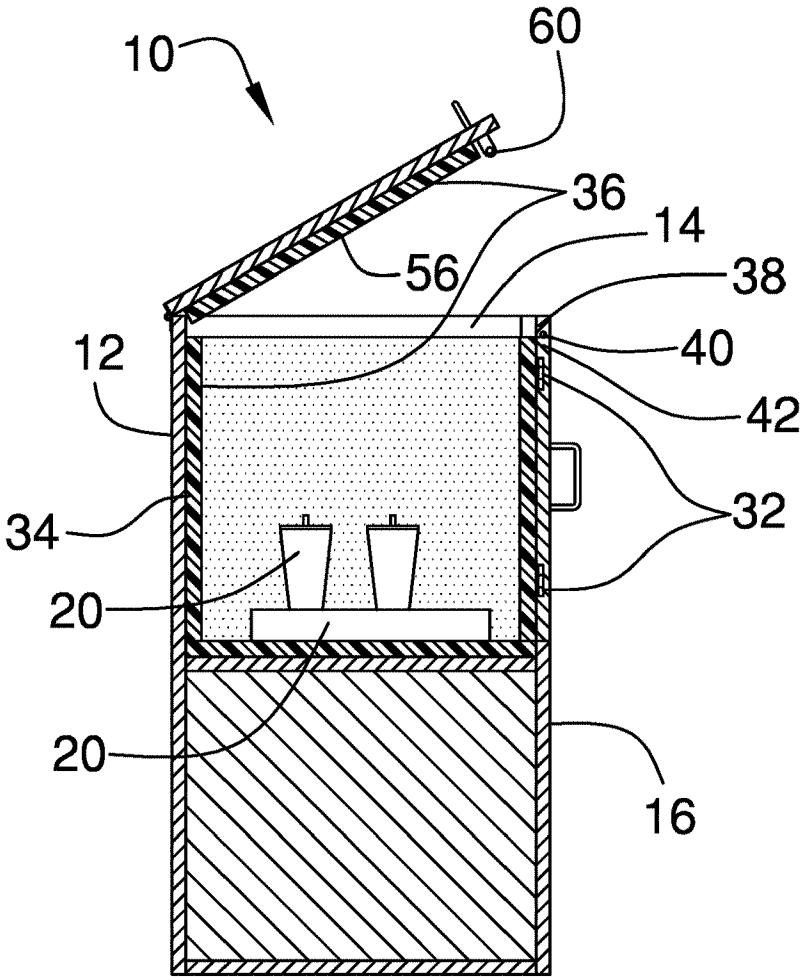
FIG. 5 is a cross-sectional view of an embodiment of the disclosure.
Figure 4:
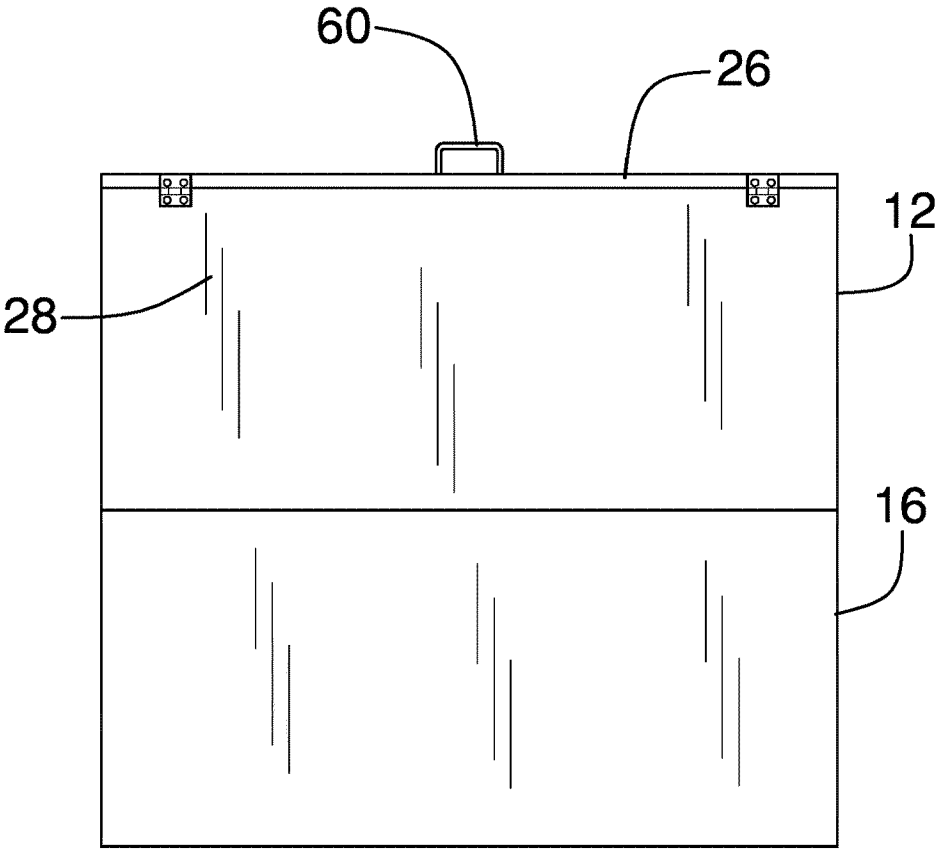
FIG. 4 is a rear view of an embodiment of the disclosure.

Each of a plurality of hinges 32 is engaged to and extends between the box 12 and a respective panel 26. The hinge 32 is recessed into an inner surface 34 of the box 12 and an inner face 56 of the respective panel 26 so that the hinge 32 is hidden from view with the respective panel 26 hinged to a closed position, as shown in FIG. 3. Each of a set of handles 60 may be engaged to a respective panel 26 to facilitate hinging of the respective panel 26 relative to the box 12.

Insulation 36 is engaged to the inner surface 34 of the box 12 and to the inner face 56 of each panel 26. The insulation 36 is configured to reduce heat transfer between food in the food container 20 and air outside of the box 12. The insulation 36 helps to keep warm food warm and cold food cold, provided both warm food and cold food are not concurrently positioned in the box 12. The present invention anticipates two compartments (not shown) within the box 12, one of which could be used for cold food and the other of which could be used for warm food.

Each of a set of locks 38 is engaged to the box 12 and is selectively engageable to a respective panel 26. The locks 38 are electronically actuated and are configured to be actuated to deter unauthorized access to the food container 20. The locks 38 are configured to be deactivated to permit authorized access to the food container 20. The box 12 is anticipated to be useful in protecting food from theft, inclement weather, and animal predation. The box 12 also may be used for small parcel delivery.

Each lock 38 comprises a latch rod 40 and an actuator 42. The actuator 42 is operationally engaged to the latch rod 40 and is configured to selectively motivate the latch rod 40 through a latch ring 44, which is engaged to the respective panel 26. The respective panel 26 thus is prevented from hinging relative to the box 12. Other locking means will be apparent to those skilled in the art of locks and are anticipated by the present invention.

A controller 46 is engaged to the box 12 and is communicatively coupled to set of locks 38. The controller 46 is configured to be manipulated by a user to selectively deactivate one or more of the locks 38, enabling the user to access the food container 20. The controller 46 may comprise a keypad 48, as shown in FIG. 3, or other controlling means, such as, but not limited to, biometric scanners, paired receivers and transmitters, and the like. The keypad 48 is configured for entry of a pin code to deactivate one or more of the locks 38. The keypad 48 may comprise a set of buttons 50. The present invention anticipates unique pin codes being generated by restaurants accepting food orders, with these codes being entered by a delivery agent to open a respective panel 26 to position the food container 20 in the box 12, and by the user to retrieve the food container 20.

The controller 46 also comprises an indicator 58, which is configured to indicate one or both of a successful manipulation and unsuccessful manipulation of the controller 46. As shown in FIG. 3, the indicator 58 comprises a green light emitting diode 52 and a red light emitting diode 54, which are configured to selectively illuminate to indicate successful manipulation and unsuccessful manipulation of the controller 46, respectively.

In use, the food delivery receptacle assembly 10 is positioned in a location where it can be accessed by a delivery agent, such as proximate to a door of a residence, as shown in FIG. 6. At least one of the panels 26 is left unlocked, or a pin code is provided to the delivery agent, who then positions the food container 20 in the box 12 and secures the panel 26 over the opening 14 by engaging a respective lock 38. The insulation 36 helps to maintain a temperature of food in the food container 20 until it is retrieved by a user. To access the food container 20, the user enters a pin code to deactivate one or more of the locks 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A food delivery receptacle assembly comprising:

a box;

a set of openings positioned in the box, wherein a respective opening is configured for insertion of a food container into the box, wherein the set of openings comprises one opening positioned in a front of the box and one opening positioned in a top of the box;

a set of panels hingedly engaged to the box, such that each panel is positioned for selectively closing a respective opening;

insulation engaged to an inner surface of the box and an inner face of each panel, wherein the insulation is configured reducing heat transfer between food in the food container and air outside of the box; and a set of locks engaged to the box, each lock being selectively engageable to a respective panel, the locks being electronically actuated, wherein the locks are configured being actuated for deterring unauthorized access to the food container and for being deactivated for permitting authorized access to the food container.

2. The food delivery receptacle assembly of claim 1, further including a base engaged to and extending from a bottom of the box, such that the box is elevated above a surface upon which the base is positioned.

3. The food delivery receptacle assembly of claim 1, wherein each lock comprises:

a latch rod; and an actuator operationally engaged to the latch rod and being configured for selectively motivating the latch rod through a latch ring engaged to the respective panel, such that the respective panel is prevented from hinging relative to the box.

4. The food delivery receptacle assembly of claim 1, further including a controller engaged to the box and being communicatively coupled to set of locks, wherein the controller is configured for being manipulated by a user for selectively deactivating one or more of the locks, enabling the user for accessing the food container.

5. The food delivery receptacle assembly of claim 4, wherein the controller comprises a keypad, wherein the keypad is configured for entry of a pin code for deactivating one or more of the locks.

6. The food delivery receptacle assembly of claim 5, wherein the keypad comprises set of buttons.

7. The food delivery receptacle assembly of claim 4, further including the controller comprising an indicator configured for indicating one or both of a successful manipulation and unsuccessful manipulation of the controller.

8. The food delivery receptacle assembly of claim 7, wherein the indicator comprises a green light emitting diode and a red light emitting diode configured for selectively illuminating for indicating successful manipulation and unsuccessful manipulation of the controller, respectively.

9. The food delivery receptacle assembly of claim 1, further including a plurality of hinges, each hinge being engaged to and extending between the box and a respective panel, the hinge being recessed into the inner surface of the box and the inner face of the respective panel, such that the hinge is hidden from view with the respective panel hinged to a closed position.

10. The food delivery receptacle assembly of claim 1, wherein the set of panels comprises two panels, each panel being hingedly engaged to the box proximate to a respective opposed side of the box, such that the panels are positioned for closing the opening positioned in the front of the box.

11. The food delivery receptacle assembly of claim 1, wherein the set of openings comprises two openings positioned singly in a front and a top of the box.

12. The food delivery receptacle assembly of claim 11, wherein the set of panels comprising three panels, one panel being hingedly engaged to the box proximate to a back of the box, such that the panel is positioned for closing the opening positioned in the top of the box, each of the other two panels being hingedly engaged to the box proximate to a respective opposed side of the box, such that the panels are positioned for closing the opening positioned in the front of the box.

13. A food delivery receptacle system comprising:

a box;

a food container positioned within the box;

a set of openings positioned in the box, wherein the set of openings comprises one opening positioned in a front of the box and one opening positioned in a top of the box;

a set of panels hingedly engaged to the box, such that each panel is positioned for selectively closing a respective opening;

insulation engaged to an inner surface of the box and an inner face of each panel, wherein the insulation is configured reducing heat transfer between food in the food container and air outside of the box; and a set of locks engaged to the box, each lock being selectively engageable to a respective panel, the locks being electronically actuated, wherein the locks are configured being actuated for deterring unauthorized access to the food container and for being deactivated for permitting authorized access to the food container.

14. A food delivery receptacle assembly comprising:

a box;

a base engaged to and extending from a bottom of the box, such that the box is elevated above a surface upon which the base is positioned;

a set of openings positioned in the box, wherein a respective opening is configured for insertion of a food container into the box, the set of openings comprising two openings positioned singly in a front and a top of the box;

a set of panels hingedly engaged to the box, such that each panel is positioned for selectively closing a respective opening, the set of panels comprising three panels, one panel being hingedly engaged to the box proximate to a back of the box, such that the panel is positioned for closing the opening positioned in the top of the box, each of the other two panels being hingedly engaged to the box proximate to a respective opposed side of the box, such that the panels are positioned for closing the opening positioned in the front of the box;

a plurality of hinges, each hinge being engaged to and extending between the box and a respective panel, the hinge being recessed into an inner surface of the box and an inner face of the respective panel, such that the hinge is hidden from view with the respective panel hinged to a closed position;

insulation engaged to the inner surface of the box and the inner face of each panel, wherein the insulation is configured reducing heat transfer between food in the food container and air outside of the box;

a set of locks engaged to the box, each lock being selectively engageable to a respective panel, the locks being electronically actuated, wherein the locks are configured being actuated for deterring unauthorized access to the food container and for being deactivated for permitting authorized access to the food container, each lock comprising:

a latch rod, and an actuator operationally engaged to the latch rod and being configured for selectively motivating the latch rod through a latch ring engaged to the respective panel, such that the respective panel is prevented from hinging relative to the box;

a controller engaged to the box and being communicatively coupled to set of locks, wherein the controller is configured for being manipulated by a user for selectively deactivating one or more of the locks, enabling the user for accessing the food container, the controller comprising a keypad, wherein the keypad is configured for entry of a pin code for deactivating one or more of the locks, the keypad comprising a set of buttons; and the controller comprising an indicator configured for indicating one or both of a successful manipulation and unsuccessful manipulation of the controller, the indicator comprising a green light emitting diode and a red light emitting diode configured for selectively illuminating for indicating successful manipulation and unsuccessful manipulation of the controller, respectively.

* * * * *